US006350160B1

(12) United States Patent
Feuersanger et al.

(10) Patent No.: US 6,350,160 B1
(45) **Date of Patent: *Feb. 26, 2002**

(54) MEDICAL CONNECTOR SYSTEM AND METHOD OF USE

(76) Inventors: Robert Feuersanger, 16 Westwind Road, Andover, MA (US) 01810; Hans Patrick Griesser, 11668 NE. Sunset Loop, Bainbridge Island, WA (US) 98110; Eric Jonsen, 7956 10th Ave. SW., Seattle, WA (US) 98106; Patrick L. Hauge, 4629 164th Ave. SE., Bellevue, WA (US) 90006

( * ) Notice: Subject to any disclaimer, the term of this patent is extended or adjusted under 35 U.S.C. 154(b) by 0 days.

This patent is subject to a terminal disclaimer.

(21) Appl. No.: 09/666,718

(22) Filed: Sep. 20, 2000

(51) Int. Cl.[7] ..... H01R 13/64
(52) U.S. Cl. ..... 439/680; 439/909
(58) Field of Search ..... 439/680, 674, 439/677, 909

(56) References Cited

U.S. PATENT DOCUMENTS 4,759,730 A * 7/1988 Sappington et al. ..... 439/680
5,120,246 A * 6/1992 Knox ..... 439/680
5,951,598 A 9/1999 Bishay et al.
5,954,520 A * 9/1999 Schmidt ..... 439/680
5,967,817 A * 10/1999 Greenstein ..... 439/680
6,048,218 A * 4/2000 Greestein ..... 439/680

FOREIGN PATENT DOCUMENTS

GB 2208759 A * 12/1989 ..... 439/680

* cited by examiner

*Primary Examiner*—Tho D. Ta

(57) ABSTRACT

A medical connector and adapter system that includes: a male cable connector, and a female cable-receiving housing for electrically coupling with the male cable connector. The male cable connector has a protrusion that is adapted to slide over the wall of the female cable-receiving housing. In one embodiment, the protrusion prevents the male cable connector from mating with a female cable-receiving housing that is incorporated into the housing of a defibrillator when there is no accommodation in the defibrillator housing to receive the protrusion. Further the male cable connector is electrically connected to pediatric electrodes and enables pediatric electrodes to be used with a manual defibrillator.

17 Claims, 4 Drawing Sheets

MEDICAL CONNECTOR SYSTEM AND METHOD OF USE

RELATED APPLICATION

This application is related to co-pending application No. 09/562,464 for "Medical Connector System and Method of Use," filed May 1, 2000, the specification of which is incorporated herein.

BACKGROUND OF THE INVENTION

The invention is directed towards a medical connector apparatus and system. More particularly, this invention is directed towards a medical connector apparatus wherein the male cable connector additionally comprises a protrusion that may prevent complete insertion and electrical connection with a female cable connector when the female cable connector is not adapted to receive the male cable connector with the protrusion.

Sudden cardiac death is the leading cause of death in the United States, with one person dying every two minutes. Most sudden cardiac death is caused by ventricular fibrillation ("VF"), in which the heart's muscle fibers contract without coordination, thereby interrupting normal blood flow to the body. When VF occurs, the patient loses consciousness as a result of the interruption in blood flow. The only known effective treatment for VF is electrical defibrillation, in which an electrical pulse is applied to the patient's heart. The electrical pulse must be delivered within a short time after onset of VF in order for the patient to have any reasonable chance of survival. Electrical defibrillation may also be used to treat shockable ventricular tachycardia ("VT"). Accordingly, defibrillation is the appropriate therapy for any shockable rhythm, i.e., VF or shockable VT. In delivering defibrillation therapy to treat VF or shockable VT, because the cardiac rhythm is disorganized, delivery of therapy is not synchronized to the cardiac rhythm. Defibrillators include manual defibrillators and automatic or semi-automatic defibrillators (AEDs).

Because of size and complexity, manual defibrillators are typically used only by emergency medical personnel with advanced training in interpreting ECG signals. Manual defibrillators enable the trained personnel to select energy settings for delivery of electrical therapy. AEDs on the other hand, may be used by lay persons with minimal training because AEDs are designed to analyze the heart rhythm and to determine the appropriateness of defibrillation therapy for the user. Thus, the user of the AED need only know how to deploy the AED and, in the case of semi-automatic AEDs, activate therapy delivery upon AED instruction.

As the use of AEDs has become increasingly common, it has become important for defibrillators, particularly AEDs, to be able to treat a wide variety of patients using one device. As new devices are built that take into consideration the need to deliver defibrillation to a wide variety of patients, changes to electrode pad designs will result to accommodate these needs. However, because older AEDs and manual defibrillators are not configured to accommodate multiple electrode pad configurations, such as pediatric electrode pads, it is important that such new pads are not usable in those devices. For example, in some instances the new pads may include circuitry, such as an attenuator, that affects the performance of the electrode pad or reduces the amount of energy delivered. Equally important, is preventing electrode pads that include, for example, attenuation circuitry from being used in a manual defibrillator because the operator could manually select an appropriate energy level for therapy and then have that energy attenuated to a lower amount. The net effect being that the desired amount of energy is not delivered to the patient.

Therefore, what is needed is a medical connector system that enables a manual defibrillator to use unattenuated AED electrode pads or other pads appropriate for use with the defibrillator but which does not allow the use of, for example, attenuated AED electrode pads for use on pediatric patients.

SUMMARY OF THE INVENTION

This invention has a male cable connector and a female cable receiving housing and combinations thereof. Together the male cable connector and female cable receiving housing form an electrode system. The male cable connector has a shell having an interior surface and an exterior surface; at least two electrical conductors electrically connected to one or more conductive sockets formed within the interior surface of the shell; a semi-cylindrical channel formed in the shell adapted to slide over and surround a semi-cylindrical surface of a female cable-receiving housing unit into which the cable connector is inserted to make electrical contact between the cable connector and the housing unit; and a protrusion extending from the shell and adapted to slide over a wall of the female cable-receiving housing unit. A wiping portion may be included on the male cable connector to provide a wiping action when the male cable connector is inserted into the female cable-receiving housing. A light covering may also be provided. The male cable connector may be in the form of an adapter or may be electrically connected to electrodes, the defibrillator, or both electrodes and defibrillator. Electrodes include monitoring electrodes, pacing electrodes, defibrillation electrodes, or electrodes capable of performing any combination thereof. The electrodes may be adult electrodes or pediatric electrodes. Where pediatric electrodes are used, the electrodes may be attenuated or unattenuated. As discussed above, there are at least two electrical conductors connected to at least one conductive socket. However, other combinations are possible. For example, four electrical conductors could be electrically connected to two conductive sockets. The protrusion of the male cable connector could be in the form of a clip, a skirt, a shroud, or any other suitable non-rib protrusion. It is contemplated that the protrusion is formed so that it slides over the wall of the female cable-receiving housing. The male cable connector may also be adapted to electrically mate with a female cable-receiving housing when the female cable-receiving housing has an interior chamber with a semi-cylindrical surface extending into the interior chamber, at least two electrical connectors within the chamber, a front end having an aperture for receiving the electrical medical cable connector, and an accommodation enabling the protrusion of the male cable connector to slide over the wall of the female cable-receiving housing.

An electrical medical connector apparatus may also comprise: a female cable-receiving housing and an electrical medical cable connector, the female cable-receiving housing having an interior chamber with a semi-cylindrical surface extending into the interior chamber, the female cable-receiving housing further comprising at least two housed electrical connectors therein, and a front end having an aperture for receiving an electrical medical cable connector, wherein the male electrical medical cable connector comprises, at least two electrical conductors electrically connected to one or more conductive sockets within a shell of the electrical medical cable connector, wherein the conductive electrical sockets of the male cable connectors is connected to the electrical conductors; a semi-cylindrical channel formed in the shell adapted to slide over and surround the semi-cylindrical surface of the housing unit when the cable connector is inserted to make electrical contact between the cable connector and the housing unit, and further wherein the shell of the electrical medical cable connector has a protrusion adapted to slide over a wall of the female cable-receiving housing. The electrical medical cable connector could then further comprise a wiping portion adapted to providing a wiping action to the housed electrical connectors. Also, the housing unit may be formed from a rigid material and the electrical medical cable connector may be formed from a pliable material.

A method of using a medical connector system of this invention would comprise the steps of: electrically connecting a male medical connector to a pair of electrodes; inserting the male medical connector having a protrusion into a female cable-receiving housing wherein, if the female cable-receiving housing enables the protrusion of the male medical connector to be accommodated along an exterior wall of the female cable-receiving housing upon insertion of the male medical connector into the female cable-receiving housing, an electrical connection between the male medical connector and the female cable-receiving housing will be made, and if the female cable-receiving housing does not enable the protrusion of the male medical connector to be accommodated along an exterior wall of the female cable-receiving housing upon insertion of the male medical connector into the female cable-receiving housing, an electrical connection between the male medical connector and the female cable-receiving housing will not be made. The additional step of electrically connecting the female cable receiving housing to a defibrillator could also be performed, and would be appropriate where, for example, the female cable-receiving housing is an adapter or is located on a patient cable. Either or both of the electrically connecting steps could be performed at time of manufacture or at another time, such as during deployment.

A method of using a medical connector system alternatively would comprise: electrically connecting a male medical connector to a pair of pediatric electrodes; inserting the male medical connector having a protrusion into a female cable-receiving housing wherein, if the female cable-receiving housing enables the protrusion of the male medical connector to be accommodated along an exterior wall of the female cable-receiving housing upon insertion of the male medical connector into the female cable-receiving housing, an electrical connection between the male medical connector and the female cable-receiving housing will be made, and if the female cable-receiving housing does not enable the protrusion of the male medical connector to be accommodated along an exterior wall of the female cable-receiving housing upon insertion of the male medical connector into the female cable-receiving housing, an electrical connection between the male medical connector and the female cable-receiving housing will not be made. The additional step of electrically connecting the female cable receiving housing to a defibrillator could also be performed, and would be appropriate where, for example, the female cable-receiving housing is an adapter or is located on a patient cable. Again, either or both of the electrically connecting steps could be performed at time of manufacture or at another time, such as during deployment.

DETAILED DESCRIPTION OF THE INVENTION

The following discussion is presented to enable a person skilled in the art to make and use the invention. Various modifications to the preferred embodiment will be readily apparent to those skilled in the art, and the generic principles defined herein may be applied to other embodiments and applications without departing from the spirit and scope of the present invention as defined by the appended claims. Thus, the present invention is not intended to be limited to the embodiments shown, but is to be accorded the widest scope consistent with the principles and features disclosed herein.

The invention is a medical connector apparatus that includes: (1) a female cable-receiving housing having at least a first conductive portion, (2) a male mating connector having at least a second conductive portion, wherein the conductive portion of the female cable-receiving housing and the conductive portion of the male mating connector are electrically coupled when mated. A protrusion is provided on the male mating connector. The protrusion has a parallel portion that is substantially parallel to an exterior wall of the male mating connector. The protrusion functions to limit the ability of the male cable connector to electrically connect to the female cable-receiving housing when, for example, the housing is integral to the housing of an AED. The protrusion, however, does not affect the ability to make an electrical connection when, for example, the female cable-receiving housing is formed as an adapter. Of course, as will be appreciated by those of skill in the art, the female cable-receiving housing may be incorporated into the housing of the defibrillator in such a way as to allow the male cable connector to make electrical contact, thus the incorporation of the female cable-receiving housing accommodates the existence of the protrusion. In this embodiment, a channel, groove, or some other accommodation is made between the wall of the female cable-receiving housing and the housing of the defibrillator to enable the male cable connector with the protrusion to completely mate with the female cable-receiving housing. Other accommodations include, but are not limited to, forming the female cable-receiving housing within the defibrillator housing so that only a portion of the female cable-receiving housing is surrounded by the defibrillator housing and a portion of the female cable-receiving housing essentially forms an exterior wall of the defibrillator. In this scenario, the protrusion could easily mate with the female cable-receiving housing.

Figure 1:
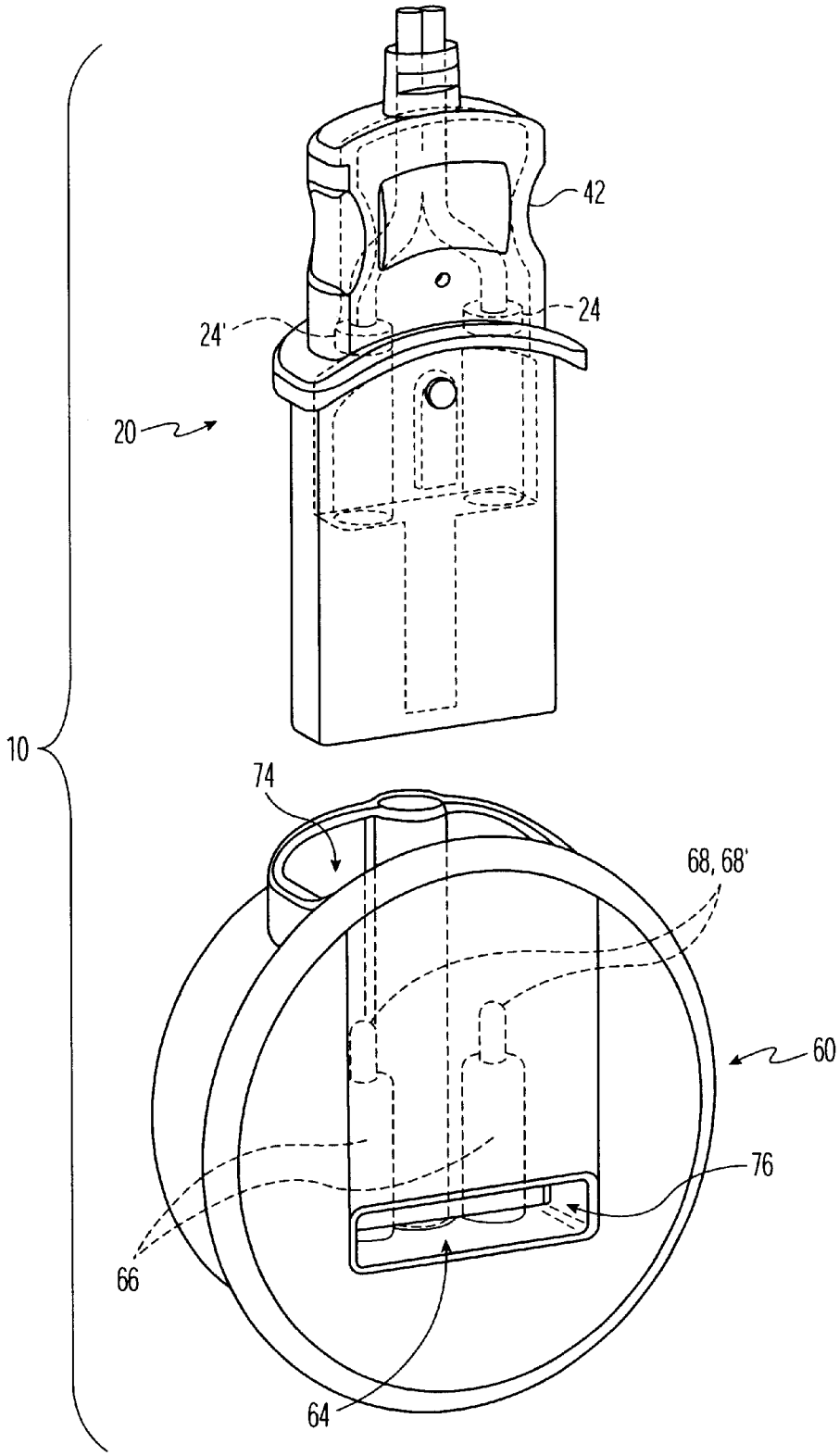
FIG. 1 PRIOR ART
FIG. 1 illustrates a presently available medical connector apparatus having a male cable connector and a female cable receiving housing.

FIG. 1 illustrates a medical connector apparatus 10 used in conjuction with the Heartstream ForeRunner AED manufactured by Agilent Technologies (Palo Alto Calif.). The medical connector apparatus includes (1) a male cable connector 20 having two conductive sockets, and (2) a female cable-receiving housing 60 having two conductive pins 68 and 68' for coupling to the two conductive sockets on the male cable connector. The female cable-receiving housing 60 has two apertures 74, 76 that extend between interior chamber 64 and the exterior of the housing unit 60. First aperture 74 is formed on the top side of housing unit 64. Through this aperture, male cable connector 20 is inserted into the interior chamber 64 of the female cable-receiving housing 60 to couple sockets 24, 24' of the male cable connector 20 to pins 68, 68' of the female cable-receiving housing 60.

Second aperture 76, on the other hand, is formed on the flat back side of the housing unit. The second aperture 76 serves as an outlet for environmental residue that may be present in the interior chamber. Specifically, when the male cable connector 20 is inserted through the first aperture 74 of the female cable-receiving housing 60, environmental residue is forced out of the interior chamber 64 through this second outlet 76, because of the depression force created by the insertion of the male cable connector 20.

Further details of the medical connector apparatus of FIG. 1 are described in more detail in U.S. Pat. No. 5,967,817 to Greenstein for "Medical Connector Apparatus," the specification of which is incorporated herein.

Figure 2:
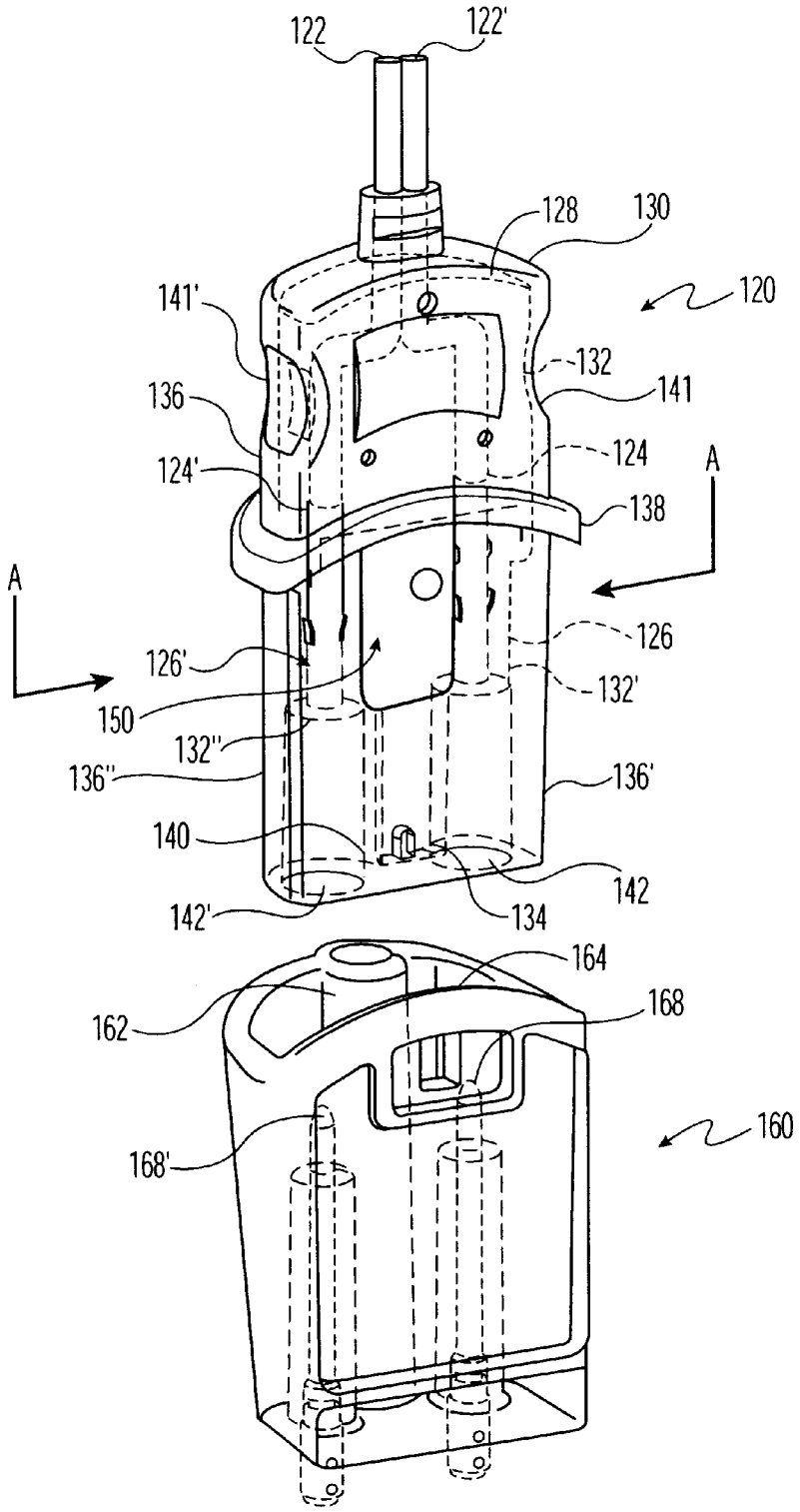
FIG. 2 illustrates a medical connector apparatus according to the present invention having a male connector further having a protrusion adapted to slide over at least a portion of the socket wall of the female cable receiving housing.

Turning now to the embodiment of the invention shown in FIG. 2, a male cable connector apparatus 120 is shown. The male cable connector 120 communicates with a female cable-receiving housing 160. As will be appreciated by those of skill in the art, when the female cable-receiving housing 160 is integral with the receiving device, e.g., the defibrillator, the male cable connector 120 may be prevented from electrically connecting with the female cable-receiving housing 160 by protrusion 150. However, when the female cable-receiving housing 160 is integral with the defibrillator in such a way as to accommodate protrusion 150, the male cable connector 120 will not be prevented from mating or electrically connecting. Design accommodations include, for example, forming a channel or slot in the defibrillator housing to receive the protrusion, or integrating the female cable-receiving housing so that a portion of a wall of the female cable-receiving housing forms a portion of the wall of the defibrillator housing.

Male cable connector 120 includes, in this embodiment, two insulated electrical conductors 122, 122' in the form of wires, and two corresponding conductive sockets 124, 124', that connect electrode pads (not shown) to the male cable connector 120. In operation, the sockets, make electrical contact between the electrode pads (now shown) and conductive pins 168, 168' in assembly 160. As discussed above, male cable connector 120 includes a protrusion 150. Protrusion 150 slides over the wall of the female cable-receiving housing 160 upon insertion enabling the male cable connector 120 to make electrical contact with the female cable-receiving housing 160. As will be appreciated by those of skill in the art, the protrusion 150 can be in the form of a "clip", or clip-like mechanism, similar to the type that would be found on an ink pen, a "skirt" surrounding some portion of the connector, a shroud, or the like. For example, protrusion 150 extends from the body of the male cable connector 120 for a distance prior to forming a bend and extending parallel, or substantially parallel, to the body of the male cable connector 120. The is distance between the body of the male cable connector 120 and the parallel portion of the protrusion 150 (where the protrusion is parallel, or substantially parallel, to a portion of the body of the male cable connector 120 is of a sufficient distance to enable the male cable connector 120 to be inserted into the female cable-receiving housing 160 without abutting the exterior wall of the female cable-receiving housing 160. The protrusion 150 may be molded from one or more pieces and then adhered to the male cable connector 120 or may be formed integrally with the male cable connector 120 during the manufacturing process.

The male cable connector may be electrically connected to one or more electrodes, or may be in the form of an adapter. Electrodes may be those that are suitable for monitoring, defibrillation, pacing, or a combination thereof. It is contemplated that the male cable connector of this invention will be used in combination with unattenuated pediatric electrodes to connect the unattenuated pediatric electrodes to a manual defibrillator. Additional information relating to an electrode pad appropriate for use in a defibrillator can be found in U.S. Pat. No. 5,951,598 to Bishay et al. for "Electrode System," the specification of which is incorporated herein. Other electrode pads appropriate for use in this invention will be apparent to those of skill in the art and are not described herein in order to avoid obscuring the invention.

As will be further appreciated by those of skill in the art, a variety of electrical connector arrangements may be used without departing from the scope of the invention. These include, for example, providing two conductive rings electrically insulated from each other for a single socket. Where this scenario is employed, one or more sockets may be employed. Additional connector arrangements have not been described in order to avoid obscuring the invention, but would be readily apparent to those of skill in the art.

In attaching to the cable connector 120, electrical conductors 122, 122' electrically connect to the conductive sockets 124, 124'. Connection is typically achieved by crimping the conductive sockets 124, 124' onto a corresponding wire of the electrical conductors 122, 122'.

The housing of the male cable connector 120 may be formed from a variety of assemblies. Two such assemblies are described herein for purposes of illustration. In one illustration, connector 120 is formed from two silicone tubes 126, 126', a rigid inner encasing shell 128, and an elastic outer encasing shell 130. The housing is formed of a shell that is manufactured from a non-conductive polymer (such as nylon or polyester shell). The inner encasing shell 128 is injection molded around tubes 126, 126', sockets 124, 124', and conductors 122, 122'. The encasing shell 128 itself forms three rigid encasing portions 132, 132', 132", and a supporting portion. 134. The first rigid encasing portion 132 is molded around the connector end of electrical conductors 122, 122' and the crimped end of conductive sockets 124, 124'. Each of the other two rigid encasing portions 132', 132" encases a conductive socket 124, 124' and its corresponding silicone tube 126, 126'; together each forms a tube housing. The three rigid encasing portions 132, 132' 132"0 insulate the two conductive paths (each of which is formed by an electrical conductor 122, 122' and a socket 124, 124') from each other and from a user.

In an alternative embodiment, male cable connector 120 is formed from a rigid inner encasing shell 128 and an elastic outer encasing shell 130. The housing is formed from a shell that is manufactured from a non-conductive polymer (such as nylon or polyester shell). The inner encasing shell 128 itself is injection molded to form three rigid encasing portions 132, 132' 132", and a supporting portion 134. After connecting sockets 124, 124' to conductors 122, 122', sockets 124, 124' are snapped into rigid encasing portions 132', 132"from the side opposite 134, each forming a tube housing. Rigid encasing portion 132 encapsulates the connector end of electrical conductors 122, 122' and the crimped end of conductive sockets 124, 124'. The three rigid encasing portions 132, 132' 132"insulate the two conductive paths (each of which is formed by an electrical conductor 122, 122' and a socket 124, 124'from each other and from a user.

The rigid encasing shell 128 also includes supporting portion 134, that extends downwardly from the second and third rigid encasing portions 132', 132". This supporting portion 134 serves as a support for the center of elastic encasing shell 130, which is molded around the rigid encasing shell 128. As illustrated, elastic encasing shell 130 in turn comprises three elastic encasing portions 136, 136', 136", a flange 138, and a semi-cylindrical channel 140 formed along a portion of its length. The elastic shell's primary elastic encasing portion 136 surrounds first rigid encasing portion 132 of shell 128. As shown in FIG. 2, primary elastic encasing portion 136 has inward bends 141, 141' that enable a user to securely grip and hold male cable connector 120. As will be appreciated by those of skill in the art, other arrangements may be employed to enable the user to grip the male connector without departing from the scope and spirit of the invention.

In addition, elastic encasing shell 130 includes secondary and tertiary encasing portions 136', 136", that respectively surround tube housing formed from the rigid encasing portions 132', 132". Moreover, the secondary and tertiary encasing portions 136', 136" extend downwardly below tube housing 132', 132" to define two chambers 142, 142'. Each of these chambers 142, 142' is axially aligned with one socket 124, 124' and its corresponding silicone tube 126, 126', so that, when the male cable connector 120 is inserted into the interior chamber of the female cable-receiving housing 160, a pin 168, 168' projects through the chamber to reach its corresponding socket 124, 124' within the tube housing to make electrical contact.

A semi-cylindrical channel 140 is defined on the front side of elastic shell 130 (also shown in cross-section in FIG. 3) between second encasing portion 136' and tertiary encasing portion 136". This channel 140 (which is supported by supporting portion 134) prevents the second and tertiary encasing portions 132', 132"from loosely dangling from the connector. In addition, as further discussed below, when male cable connector 120 is inserted into the interior chamber of the female cable-receiving housing 160 the channel 140 of the male cable connector 120 slides across a semi-cylindrical rib 162 formed from, for example, a light pipe housed in female cable-receiving housing 160.

Elastic shell 130 further includes flange 138 between first encasing portion 136 and second and third encasing portions 136', 136". Flange 138 prevents the housing from being further inserted into the female cable-receiving housing 160.

Protrusion 150 extends, for example, from the flange 138 a distance and then further extends parallel to an exterior surface of the elastic shell 130. As mentioned above, the protrusion 150 can take a variety of forms provided it enables the male cable connector 120 to mate with, and electrically connect to, female cable-receiving housing 160. In this embodiment, such mating is accomplished where the gap between the protrusion 150 and the body of the male cable connector 120 approximately corresponds to the thickness of the wall of the female cable-receiving housing 160 that forms the interior chamber 164 of the female cable-receiving housing 160. Many other scenarios can be used to accomplish the same effect. For example, if it were desired, a female cable-receiving housing 160 that was embedded into a defibrillator housing could have, for example, a channel formed around the exterior of the female cable-receiving housing 160 such that the male cable connector 120 could be inserted into the female cable-receiving housing 160 and the protrusion 150 would fit within the channel formed between the wall of the female cable-receiving housing and the defibrillator housing.

It will also be appreciated by those of skill in the art, that the protrusion 150 may take many forms, as described above. Further, protrusion 150 prevents the male cable connector 120 from being inserted into a female cable receiving housing 160 which has not been configured to mate with the male cable connector 120 (such as the female cable-receiving housing 60 shown in FIG. 1 which is integral to the housing of an AED and does not provide a channel for receiving the protrusion). Some or all of protrusion 150 may be formed by a hard plastic such as that used to form rigid encasing shell 128, or by any other suitable material, provided the material will not allow the protrusion to flex substantially away from the housing of the female cable receiving housing when the male cable connected is inserted into the housing.

As shown in FIG. 2, the inner recess of interior chamber 164 of the female cable-receiving housing 160 and the outer elastic shell of male cable connector 120 are molded in a complementary fashion. In particular, as shown in FIG. 2, the bends on the corners of the front side of interior chamber 164 provide two channels supporting the curved front side of encasing portions 136', 136". In addition, semi-cylindrical channel 140 of male cable connector 120 provides a complementary surface to the cylindrical outer surface of light pipe 162. Also, the backside of both outer elastic shell 130 of the male cable connector 120 and interior chamber 164 of the female cable-receiving housing 160 are substantially flat. The female cable-receiving housing 160 is formed so that the protrusion 150 of the male cable connector 120 slides over the exterior wall of the female cable-receiving housing 160.

As will be appreciated by those of skill in the art, the male cable connector 120 or the female cable-receiving housing 160 may be configured as part of an adapter system. Thus, for example, an adapter could be configured to receive a non-compatible electrode pad on one end and to form a male cable connector 120 on the other end; enabling the non-compatible electrode pad to be attached to a device having the female cable-receiving housing 160.

Figure 3:
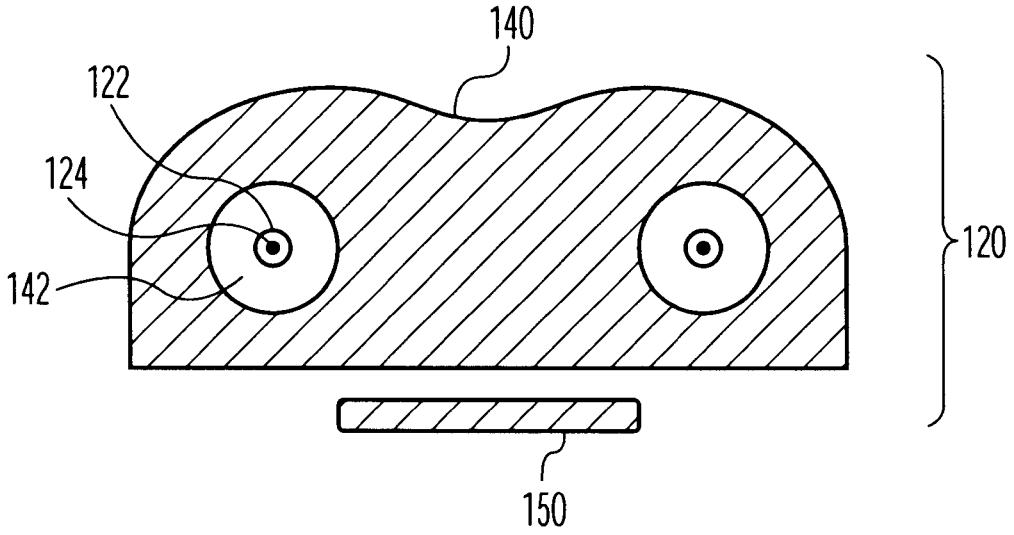
FIG. 3 illustrates a cross-sectional view of the male portion of the housing shown in FIG. 2 across the lines A—A shown in FIG. 2.

FIG. 3 illustrates a cross-section of the male cable connector 120 shown in FIG. 2 across the lines A—A. The male cable connector has a protrusion 150 extending from, for example, the flange 138 and formed substantially parallel to an exterior surface of the male cable connector 120. For purposes of illustration, the protrusion 150 has been illustrated in FIG. 3 as being parallel to the flat side of the connector and extending from the flange. However, as will be appreciated by persons of skill in the art, the protrusion 150 can be located elsewhere on the male cable connector without departing from the scope of the invention.

In use, the male cable connector 120 is unable to mate with a female cable-receiving housing 60, such as the female cable-receiving housing 60 illustrated in FIG. 1 when the female cable-receiving housing is formed within the housing of a defibrillator without accommodation for the protrusion on the male cable connector. In this situation, when an attempt is made to mate the male cable connector 120 with the female cable-receiving housing, the protrusion 150 abuts the defibrillator housing and prevents complete insertion and electrical connection of the male cable connector to the female cable-receiving housing. When, however, the female cable-receiving housing is not formed within the housing of a defibrillator, as would typically be the case for manual defibrillators with a patient cable or an adapter, or is formed to provide an accommodation of the protrusion, the male cable connector is able to mate with the female cable-receiving housing because the protrusion slides over the wall of the female cable-receiving housing.

As contemplated herein, it is beneficial, although not required, to associate the male cable connector with, for example, unattenuated pediatric electrode pads. When the male cable connector 120 is associated with unattenuated pediatric electrode pads the connector is capable of mating solely with a female cable-receiving housing 160 capable of receiving the male cable connector 120 and accommodating the protrusion 150. The female cable-receiving housing 160, however, is capable of receiving the male cable connector 120 with its protrusion 150, or the male cable connector 20 (shown in FIG. 1) that is associated with standard defibrillation or monitoring electrodes, such as that sold for use in connection with the Heartstream ForeRunner AED or FR2 AED.

Figure 4A:
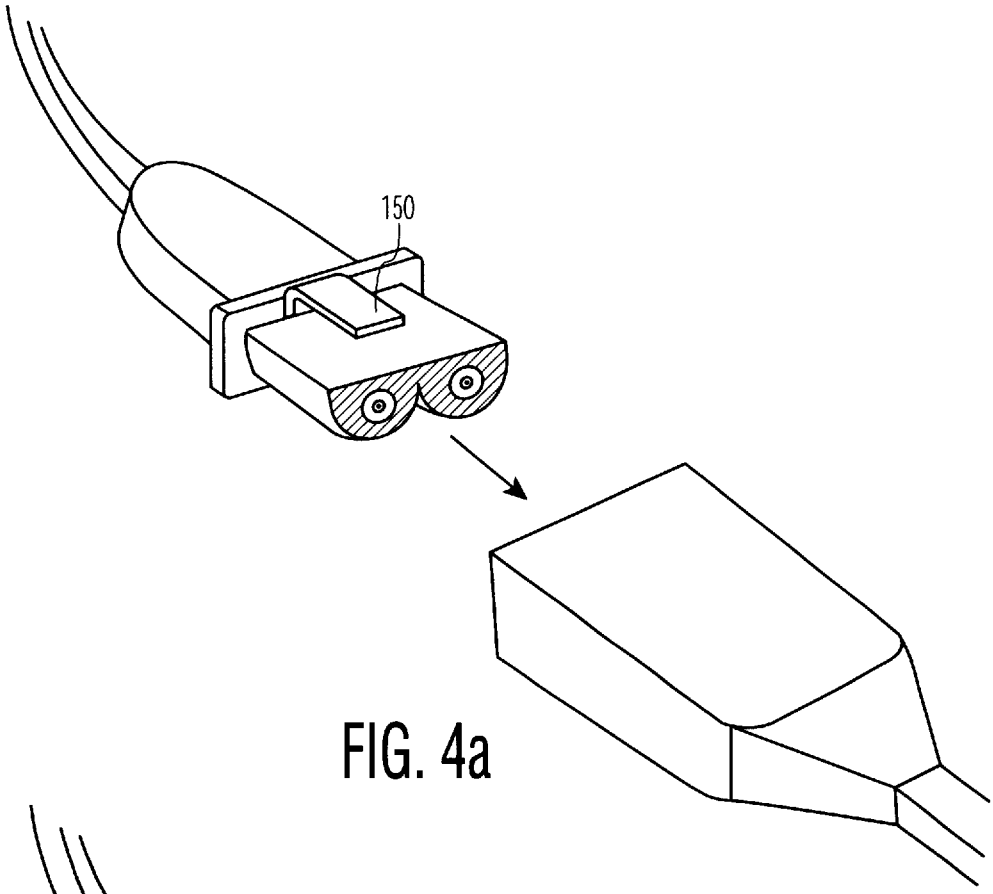
FIGS. 4*a* and 4*b* illustrate the male portion of the housing prior to insertion into a female connector and following insertion into a female connector. The protrusion slides over the wall of the female connector when the male portion is fully mated with the female connector to make electrical contact.
Figure 4B:
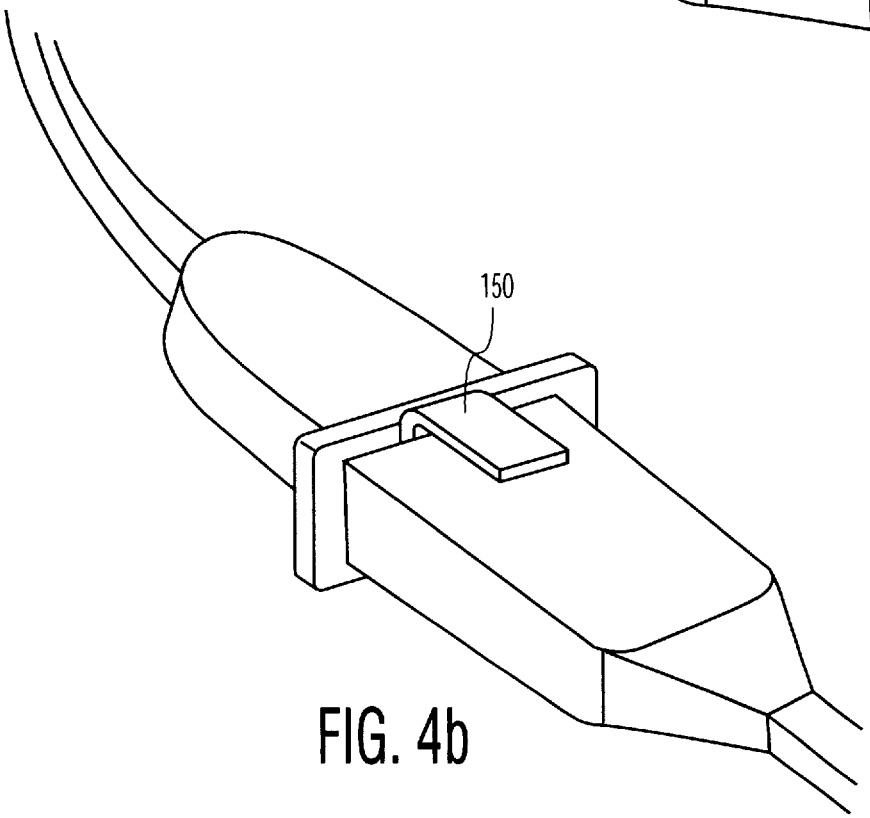

FIGS. 4*a* and 4*b* show one embodiment of the male cable connector of this invention, prior to insertion and following insertion into a female cable-receiving housing. As illustrated, the protrusion 150 slides over the wall of the female cable-receiving housing.

What is claimed is:

1. A male cable connector comprising:

a shell having an interior surface and an exterior surface;

at least two electrical conductors electrically connected to one or more conductive sockets formed within the interior surface of the shell;

a semi-cylindrical channel formed in the shell adapted to slide over and surround a semi-cylindrical surface of a female cable-receiving housing unit into which the cable connector is inserted to make electrical contact between the cable connector and the housing unit; and a protrusion extending from the shell and adapted to slide over a portion of a wall of the female cable-receiving housing unit.

2. The male cable connector of claim 1 further comprising four electrical conductors electrically connected to two conductive sockets.

3. The male cable connector of claim 1 wherein the protrusion is a clip.

4. The male cable connector of claim 1 wherein the protrusion is a skirt.

5. The male cable connector of claim 1 wherein the protrusion is a shroud.

6. The male cable connector of claim 1 wherein the male cable connector is adapted to electrically mate with a female cable-receiving housing having an interior chamber with a semi-cylindrical surface extending into the interior chamber, the female cable-receiving housing further comprising at least two electrical connectors therein, a front end having an aperture for receiving an electrical medical cable connector, and an accommodation enabling the protrusion of the male cable connector to slide over the wall of the female cable-receiving housing.

7. The male cable connector of claim 1 further comprising a wiping portion adapted to providing a wiping action to electrical connectors of a cable-receiving housing into which the male cable connector is inserted to make electrical contact between the cable connector and the housing unit.

8. The male cable connector of claim 7 further comprising a light covering portion extending over the channel and adapted to cover a light disposed within the channel when the male cable connector is inserted in the housing unit to make electrical contact between the cable connector and the housing unit.

9. The male cable connector of claim 1 further comprising a pair of pediatric electrodes electrically connected to the at least two electrical connectors formed in the interior of the shell.

10. The male cable connector of claim 9 wherein the pediatric electrodes are unattenuated.

11. An electrical medical connector apparatus comprising: a female cable-receiving housing and an electrical medical cable connector, the female cable-receiving housing having an interior chamber with a semi-cylindrical surface extending into the interior chamber, the female cable-receiving housing further comprising at least two housed electrical connectors therein, and a front end having an aperture for receiving an electrical medical cable connector, wherein the male electrical medical cable connector comprises, at least two electrical conductors electrically connected to one or more conductive sockets within a shell of the electrical medical cable connector, wherein the conductive electrical sockets of the male cable connectors is connected to the electrical conductors; a semi-cylindrical channel formed in the shell adapted to slide over and surround the semi-cylindrical surface of the housing unit when the cable connector is inserted to make electrical contact between the cable connector and the housing unit, and further wherein the shell of the electrical medical cable connector has a protrusion adapted to slide over a wall of the female cable-receiving housing.

12. The electrical medical connector apparatus of claim 11 wherein the electrical medical cable connector further comprises a wiping portion adapted to providing a wiping action to the housed electrical connectors.

13. The electrical medical connector apparatus of claim 11 wherein the housing unit is formed from a rigid material and the electrical medical cable connector is formed from a pliable material.

14. A method of using a medical connector system comprising:

electrically connecting a male medical connector to a pair of electrodes;

inserting the male medical connector having a protrusion into a female cable-receiving housing wherein, if the female cable-receiving housing enables the protrusion of the male medical connector to be accommodated along an exterior wall of the female cable-receiving housing upon insertion of the male medical connector into the female cable-receiving housing, an electrical connection between the male medical connector and the female cable-receiving housing will be made, and if the female cable-receiving housing does not enable the protrusion of the male medical connector to be accommodated along an exterior wall of the female cable-receiving housing upon insertion of the male medical connector into the female cable-receiving housing, an electrical connection between the male medical connector and the female cable-receiving housing will not be made.

15. The method step of claim 14 further comprising the step of:

electrically connecting the female cable receiving housing to a defibrillator.

16. A method of using a medical connector system comprising:

electrically connecting a male medical connector to a pair of pediatric electrodes;

inserting the male medical connector having a protrusion into a female cable-receiving housing wherein, if the female cable-receiving housing enables the protrusion of the male medical connector to be accommodated along an exterior wall of the female cable-receiving housing upon insertion of the male medical connector into the female cable-receiving housing, an electrical connection between the male medical connector and the female cable-receiving housing will be made, and if the female cable-receiving housing does not enable the protrusion of the male medical connector to be accommodated along an exterior wall of the female cable-receiving housing upon insertion of the male medical connector into the female cable-receiving housing, an electrical connection between the male medical connector and the female cable-receiving housing will not be made.

17. The method step of claim 16 further comprising the step of:

electrically connecting the female cable receiving housing to a defibrillator.

* * * * *